US007036651B2

(12) United States Patent
Tam et al.

(10) Patent No.: US 7,036,651 B2
(45) Date of Patent: May 2, 2006

(54) METHOD AND APPARATUS FOR PROCESSING CURRENCY BILLS AND COINS

(75) Inventors: Flavia Tam, Naperville, IL (US); Mark C. Munro, Barrington, IL (US); Timothy L. Esterbrook, Ingleside, IL (US); David O. Noke, Lake Zurich, IL (US); John R. Blake, St. Charles, IL (US)

(73) Assignee: Cummins-Allison Corp., Mt. Prospect, IL (US)

( * ) Notice: Subject to any disclaimer, the term of this patent is extended or adjusted under 35 U.S.C. 154(b) by 218 days.

(21) Appl. No.: 10/682,320

(22) Filed: Oct. 9, 2003

(65) Prior Publication Data

US 2005/0077142 A1 Apr. 14, 2005

(51) Int. Cl.
*G07F 9/08* (2006.01)

(52) U.S. Cl. ..... 194/217

(58) Field of Classification Search ..... 194/216, 194/215, 350, 353, 217; 700/1, 16, 17; 705/35
See application file for complete search history.

(56) References Cited

U.S. PATENT DOCUMENTS

| | | | | |
|---|---|---|---|---|
| 3,246,658 | A | 4/1966 | Buchholz et al. | 133/8 |
| 4,359,062 | A | 11/1982 | Uecker et al. | 133/2 |
| 4,682,288 | A | 7/1987 | Taipale et al. | 364/406 |
| 4,883,158 | A | 11/1989 | Kobayashi et al. | 194/217 |
| 5,954,576 | A | 9/1999 | Coulter et al. | 453/17 |

OTHER PUBLICATIONS

Mosler Operator's Manual: CF-420 Cash Management System, 72 pages, 1989.*
Product Literature for ATS Money Systems, Inc., "ATS Cash Room Management Systems," 4 pages, publication date estimated prior to Aug. 2002.
Product Literature for Brandt, Inc., "Model 4709 Cash Executive™ and Model 8700 Sett Mate™," 5 pages, publication date estimated prior to Aug. 2002.
Brochure for Brandt, Inc. "Model 4810 Cash Executive™/ Cash Settlement Controller," 2 pages, 1993.
Product Literature for Cummins-Allison Corp., "Cash Information and Settlement Systems," 4 pages, publication date estimated at least as early as Dec. 1991.
Product Literature for Glory (U.S.A.) Inc., "Deposit Master II High Speed Data Collection System," 4 pages, publication date estimated at least as early as Dec. 1991.

(Continued)

*Primary Examiner*—Donald P. Walsh
*Assistant Examiner*—Mark. J. Beauchaine
(74) *Attorney, Agent, or Firm*—Jenkens & Gilchrist

(57) ABSTRACT

A method and system for processing currency bills and coins in a cash receptacle for automatically determining a batch of currency. An operator provides an amount of cash, including currency bills and coins, and indicates a target amount of cash desired to be made available in a currency batch. The system includes a resident memory for storing a mode of operation, determines a total amount of the cash, and determines a cash removal amount by comparing the total amount of the cash to the target amount. The cash removal amount is displayed to the operator for adding or removing cash to obtain the appropriate currency batch, which corresponds to the target amount.

23 Claims, 14 Drawing Sheets

OTHER PUBLICATIONS

Brochure for De La Rue Systems Americas Corporation, "Mach 3 Cash Till Sorter/Counter," 2 pages, publication date estimated prior to Oct. 2003.
Brochure for Glory (U.S.A.) Inc., "SR-430 Cash Settlement Mini-System," 2 pages, publication date estimated at least as early as Dec. 1991.
Brochure for Glory (U.S.A.) Inc., "SR-600 Cash Settlement System," 1 page, publication date estimated at least as early as Dec. 1991.
Brochure for Glory (U.S.A.) Inc., "SR-600B Cash Settlement System For Banks," 1 page, publication date estimated at least as early as Dec. 1991.
Product Literature for Glory (U.S.A.) Inc., "SR-700 Cash Settlement System," 4 pages, 1993.
Brochure for Glory (U.S.A.) Inc., "VAS-100 Advanced Workstation Controller," 1 page, publication date estimated at least as early as Dec. 1991.
Product Literature for Glory (U.S.A.) Inc., "VAS-1000 Vault Automation System," 4 pages, publication date estimated at least as early as Dec. 1991.
Operator's Manual for Mosler: CF-420 Cash Management System, 72 pages, 1989.
Product Literature for Mosler, "CD-4000/CD-6000 Cash Dispense System—There's a Better Way to Speed Up Teller-Assist Cash Dispensing," 10 pages, 1989.
Website Publication for Tellermate—"Turning Cash Into Profit—Tellermate TY Range," 3 pages, Apr. 23, 2003.

* cited by examiner

METHOD AND APPARATUS FOR PROCESSING CURRENCY BILLS AND COINS

FIELD OF THE INVENTION

The present invention relates generally to cash processing, and, more particularly, to a system for processing currency bills and coins from a cash receptacle.

BACKGROUND OF THE INVENTION

In general, banks and retail stores use currency processing machines to process money received during the regular course of business. Machines that sort, count, and authenticate currency bills and coins have become valuable tools in maintaining accurate and up-to-date financial statements. Providing automated machines that are programmed to perform particular functions, e.g., automatically sorting and counting cash received in a register till, improves the efficiency of a business.

Some activities are performed routinely and are generally the same in all businesses that exchange currency on a daily basis. For example, retail stores generally require that all the money from a cash receptacle or register till, which includes currency bills and coins, be counted after an operator's work-shift is over, such as at the end of the day. The money from the till is counted, and then deposited into a money safe or vault. Often, a pre-selected amount of money is placed back in the till so that the next work-shift has a base amount for the start of the next shift. In the preceding example, generally, an operator must count the money from the till, compare the cash register receipts to the counted totals, and then put a base amount of money for the next work-shift in the till. Two problems associated with the "counting down" of a cash till in the described manner are the potential for human error and the time it takes to manually perform the counting tasks.

Therefore, there is a need for a system that decreases the potential for human error and decreases the amount of time involved in performing tasks related to the counting and preparation of a cash receptacle.

SUMMARY OF THE INVENTION

According to one embodiment of the present invention, a method and system for processing currency bills and coins is provided for preparing a batch of currency in a cash receptacle. An operator provides an amount of cash, including currency bills and coins, and indicates a target amount. The system includes a resident memory for storing a mode of operation, determines a total amount of the cash, and determines a cash removal amount by comparing the total amount of the cash to the target amount. The cash removal amount is displayed to the operator for adding or removing cash to prepare the cash receptacle for future use.

The above summary of the present invention is not intended to represent each embodiment, or every aspect, of the present invention. Additional features and benefits of the present invention will become apparent from the detailed description, figures and claims set forth below.

Figure 1:
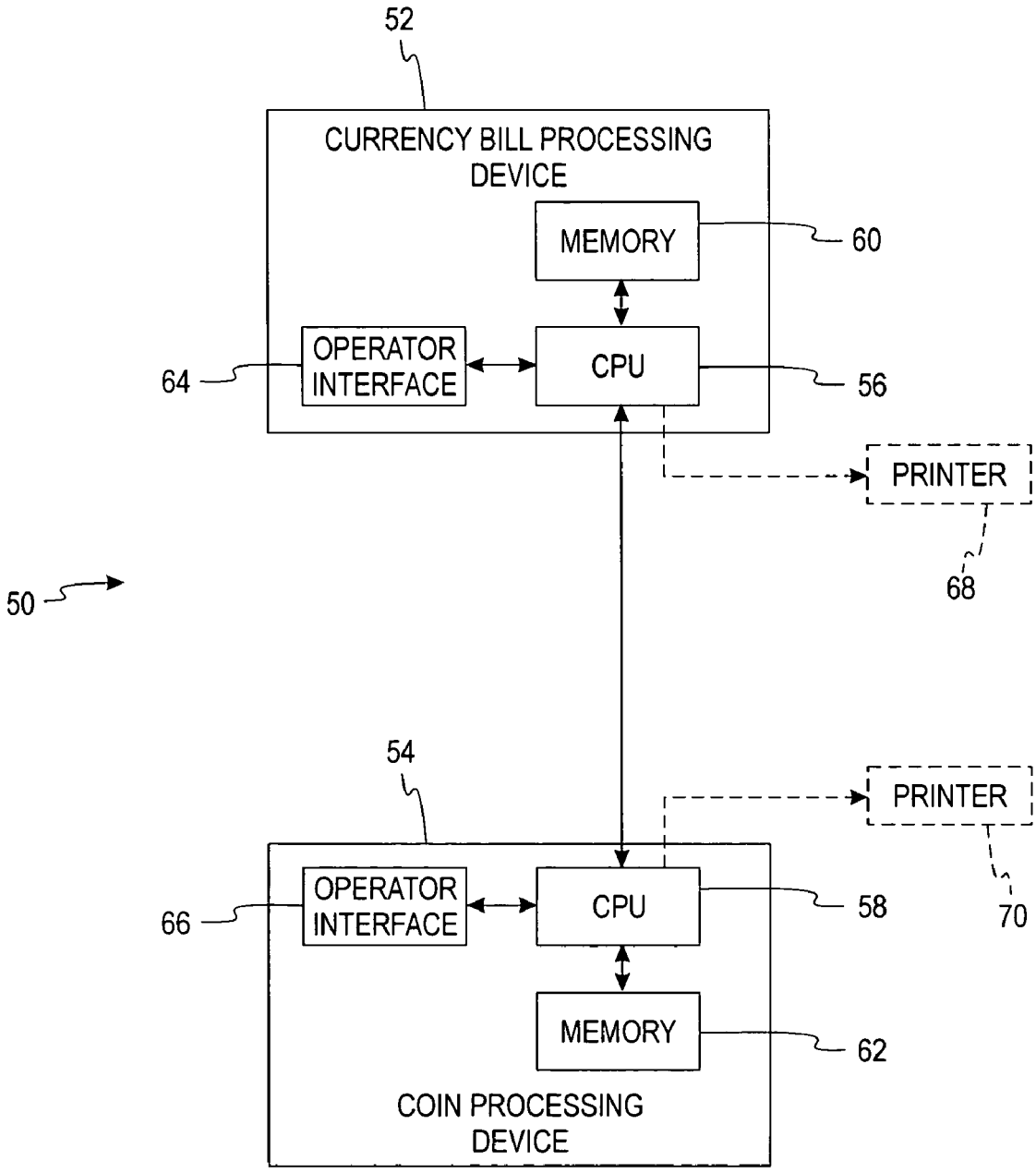
FIG. 1 is a functional block diagram of a currency bill and coin processing system according to one embodiment of the present invention.

While the invention is susceptible to various modifications and alternative forms, specific embodiments are shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE ILLUSTRATED EMBODIMENT

Figure 2:
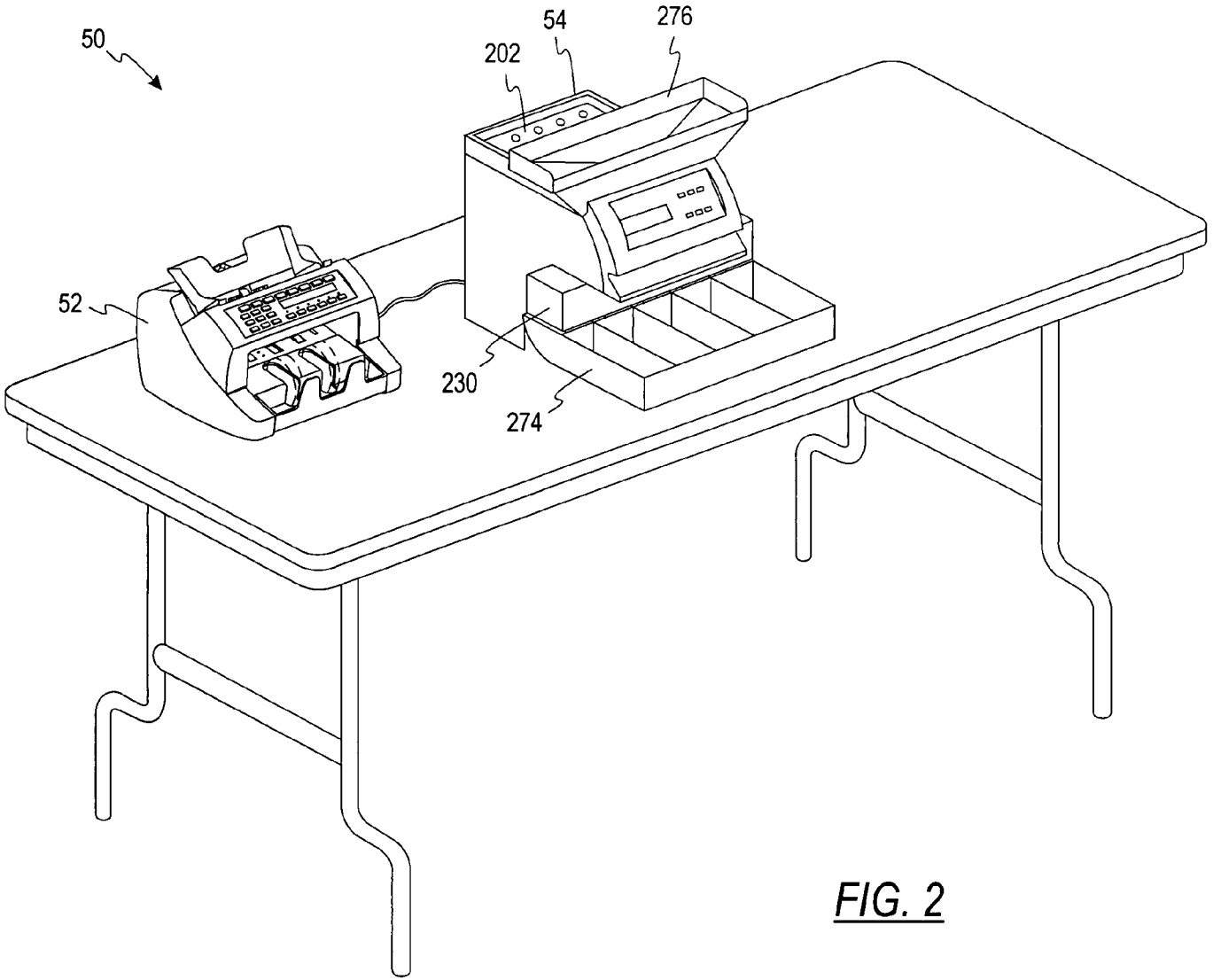
FIG. 2 is a perspective view of a currency bill and coin processing system according to one embodiment of the present invention.

Referring now to FIGS. 1 and 2, a currency bill and coin processing system 50 is shown according to one embodiment of the present invention. One use of the processing system 50 is for counting the total currency bills and coins in a batch such as, for example, a cash till at a bank or a retail store. The system 50 includes a currency bill processing device 52 for processing currency bills and a coin processing device 54 for processing coins. The system 50 can count, sort, and/or authenticate both bills and coins. The bill device 52 and the coin device 54 are communicatively linked for summing currency bill totals and coin totals determined by the respective devices. The bill device 52 and the coin device 54 may be communicatively linked by way of wires or by a wireless communication system according to alternative embodiments of the system 50.

The bill device 52 includes a processor such as a central processing unit (CPU) 56 for controlling the operation of the bill device 52, and the coin device 54 includes a CPU 58 for controlling the operation of the coin device 54. The bill CPU 56 is linked to a memory 60 for storing information such as currency bill processing results, master authenticating characteristic information, and master denominating characteristic information. The coin CPU 58 is linked to a memory 62 for storing information such as coin processing results and other coin processing information. In one embodiment of the present invention, at least one of the bill memory 60 and the coin memory 62 is resident on the corresponding device. In another embodiment, the system 50 includes either the bill CPU 56 or the coin CPU 58, wherein the included CPU controls the operation of the bill device 52 and the coin device 54. If only one CPU is included, then the corresponding memory, the bill memory 60 or the coin memory 62, stores information for both the bill device 52 and the coin device 54. As mentioned above, it is understood that the system 50 can be adapted to use the bill memory 60 and/or the coin memory 62 for storing relevant information. Alternatively, the system 50 can use instead or in addition an external memory. Furthermore, in alternative embodiments of the present invention an operator can use any one of the bill CPU 56 or the coin CPU 58 to control the bill device 52, the coin device 54, or both.

The bill device 52 includes an operator interface 64 communicatively linked to the bill CPU 56 for receiving input from and displaying information to an operator of the bill device 52. The coin device 54 includes an operator interface 66 communicatively linked to the coin CPU 58 for receiving input from and displaying information to an operator of the coin device 54. The bill operator interface 64 and the coin operator interface 66 can comprise an LCD display and a keypad or a touch-screen according to alternative embodiments of the present invention. As shown in FIG. 1, the bill operator interface 64 is an integral part of the bill device 52, and the coin operator interface 66 is an integral part of the coin device 54. Alternatively, the bill operator interface 64 is externally located from the bill device 52, and/or the coin operator interface 66 is externally located from the coin device 54. In alternative embodiments of the system 50, an external operator interface can be adapted for use in addition or instead of the bill operator interface 64 and the coin operator interface 66. Optionally, the external operator interface can be part of an external personal computer linked to the system 50.

In other embodiments, the system 50 is linked to one or more printers for providing an operator with a hardcopy of totals and results from the processing of currency bills, and/or coins. For example, a printer 68 can be linked to the bill device 52 and/or a printer 70 can be linked to the coin device 54. Either printer can provide results for either device.

Figure 3:
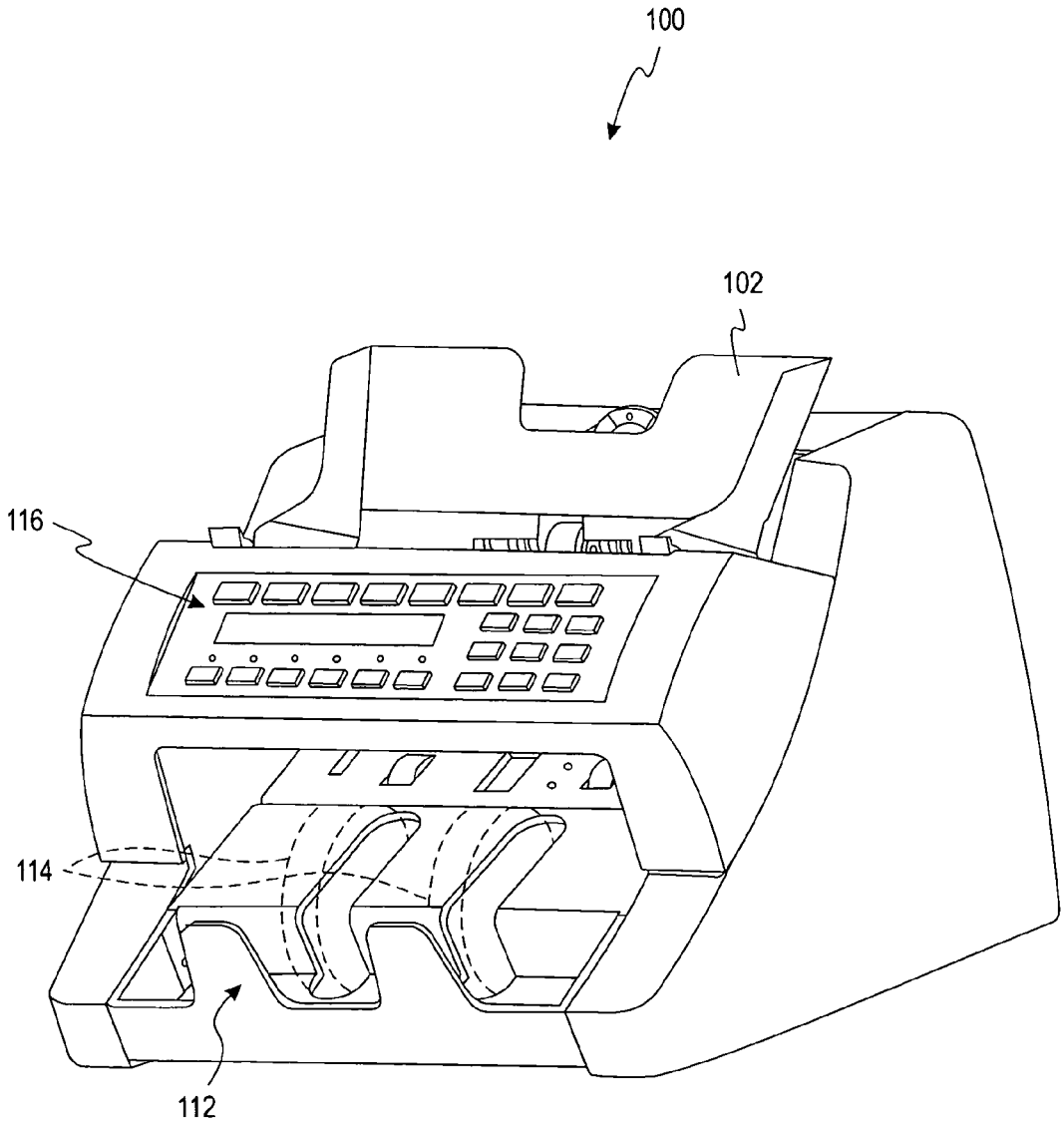
FIG. 3 is a perspective view of a single-pocket currency bill processing device for use with the currency bill and coin processing system of FIG. 1.
Figure 4:
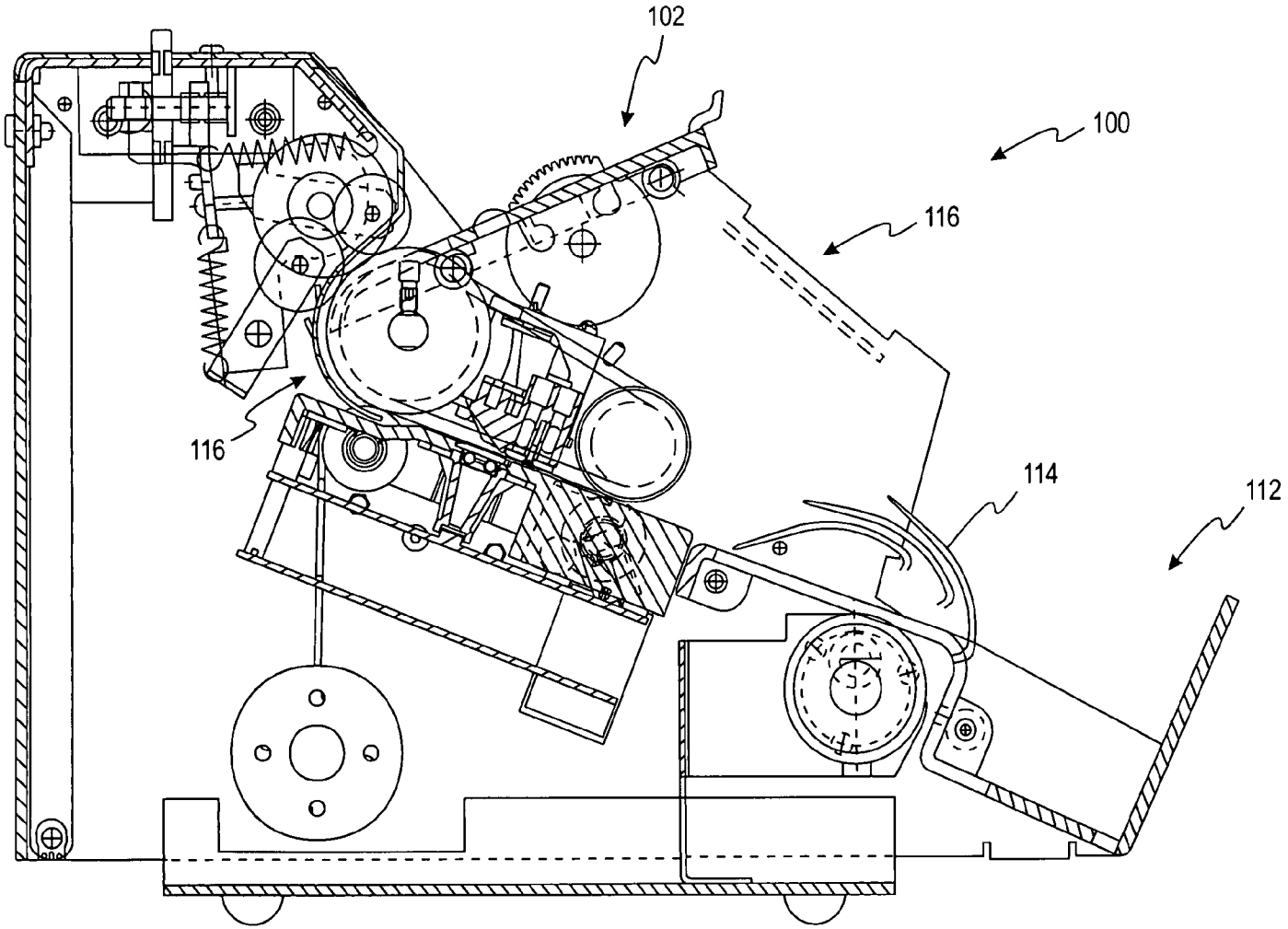
FIG. 4 is a cross-sectional view of the single-pocket device of FIG. 3.
Figure 5:
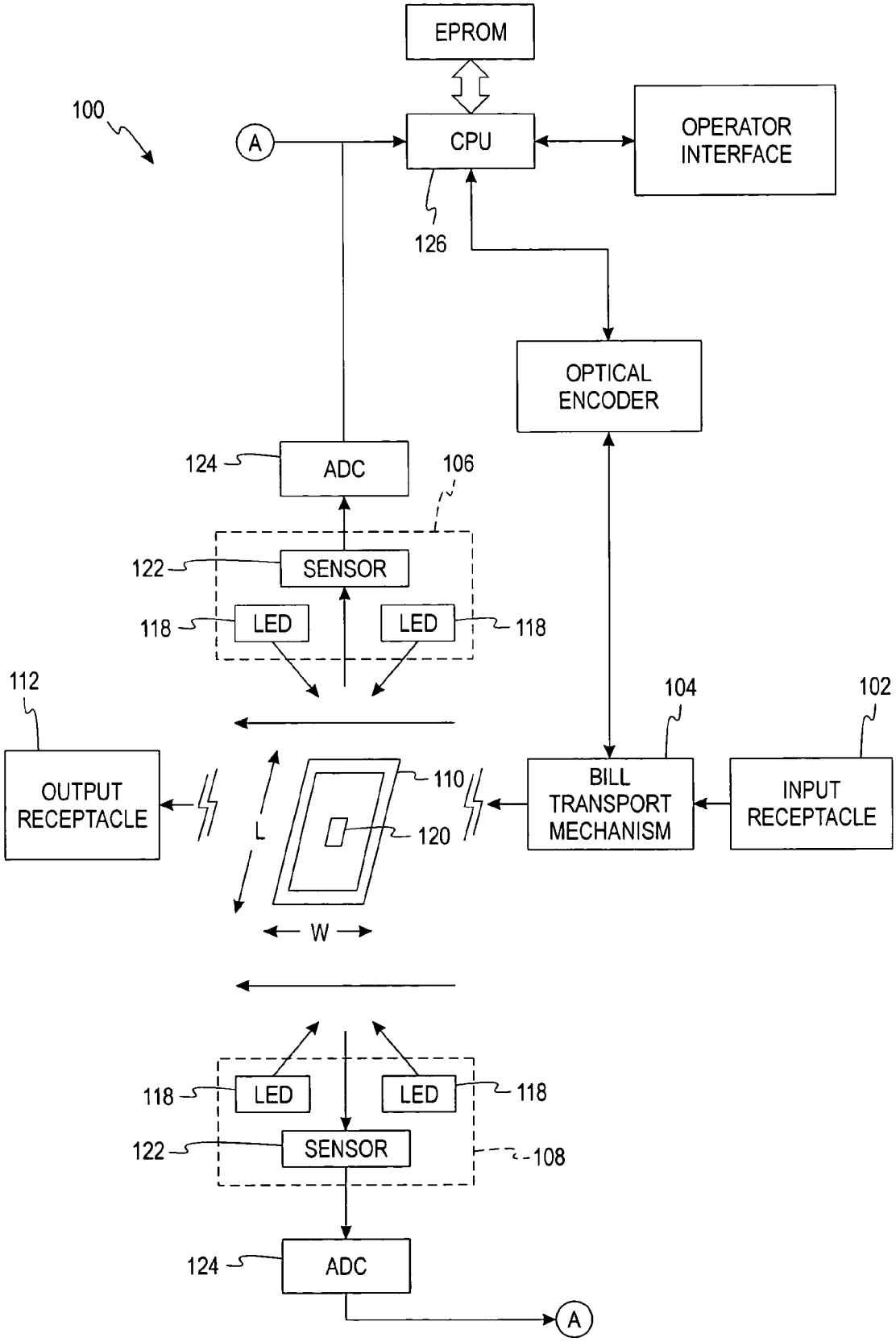
FIG. 5 is a functional block diagram of the single-pocket device of FIG. 3.

Referring now to FIGS. 3–5, a compact currency bill processing device 100 having a single output receptacle ("single-pocket device") for use with one embodiment of the system 50 will be described. The single-pocket device 100 includes an input receptacle 102 for receiving a stack of currency bills to be processed. Currency bills stacked in the input receptacle 102 are picked out or separated, one at a time, and sequentially transported by a currency bill transport mechanism 104, between a pair of scanheads 106 and 108 where, for example, the currency denomination of the currency bill is scanned and identified. In the embodiment depicted, each scanhead 106, 108 is an optical scanhead that scans for characteristic information from a currency bill 110 which is used to identify the denomination of the currency bill. The scanned currency bill 110 is then transported to an output receptacle 112, which may include a pair of stacking wheels 114, where currency bills so processed are stacked for subsequent removal.

The single-pocket device 100 includes an operator interface 116, which is shown in FIG. 3, for communicating with an operator of the single-pocket device 100. The interface 116 can function as the bill operator interface 64 (FIG. 1) of the system 50. The interface 116 receives input from and displays information to an operator of the system 50. Input data may comprise, for example, operator-selected operating modes, operator-defined operating parameters, total base amounts, and round-off amounts. Output data displayed to the operator may comprise, for example, a selection of operating modes, information relevant to the status of currency bills being processed by the single-pocket device 100, and/or a bill and coin total. In one embodiment, the interface 116 comprises a touch-screen which may be used to provide input data and display output data related to the operation of the system 50. Alternatively, the interface 116 may employ physical keys or buttons and a separate display, or a combination of physical keys and displayed touch-screen keys.

In alternative embodiments of the present invention, additional sensors can replace or be used in conjunction with the optical scanheads 106, 108 in the single-pocket device 100 to analyze, authenticate, denominate, count, and/or otherwise process currency bills. For example, size detection sensors, magnetic sensors, thread sensors and/or ultraviolet/fluorescent light sensors may be used in the single-pocket device 100 to evaluate currency bills. The use of these types of sensors for currency evaluation are described in commonly owned U.S. Pat. No. 6,278,795, which is incorporated herein by reference in its entirety.

According to one embodiment of the single-pocket device 100, each optical scanhead 106, 108 comprises a pair of light sources 118 that direct light onto the currency bill transport path. The light illuminates a substantially rectangular light strip 120 upon the currency bill 110, the illuminated strip 120 being positioned on the transport path adjacent the scanheads 106, 108. Light reflected off the illuminated strip 120 is sensed by a photodetector 122 positioned between the two light sources. The analog output of the photodetector 122 is converted into a digital signal by means of an analog-to-digital (ADC) convertor unit 124 whose output is fed as a digital input to a processor such as a CPU 126.

According to one embodiment, the currency bill transport path is defined in such a way that the transport mechanism 104 moves currency bills with the narrow dimension of the currency bills being parallel to the transport path and the scan direction. Put another way, the wide edge of a currency bill is the leading edge of the currency bill. As a currency bill 110 traverses the scanheads 106, 108, the light strip 120 effectively scans the currency bill across the narrow dimension of the currency bill. In the embodiment depicted, the transport path is so arranged that the currency bill 110 is scanned across a central section of the currency bill along its narrow dimension, as shown in FIG. 5. Each scanhead functions to detect light reflected from the currency bill as it moves across the illuminated light strip 120 and to provide an analog representation of the variation in reflected light, which, in turn, represents the variation in the dark and light content of the printed pattern or indicia on the surface of the currency bill. This variation in light reflected from the narrow dimension scanning of the currency bills serves as a measure for distinguishing, with a high degree of confidence, among a plurality of currency denominations which the system is programmed to handle.

Additional details of the mechanical and operational aspects of the single-pocket device 100 are described in detail in U.S. Pat. Nos. 5,295,196 and 5,815,592, each of which is incorporated herein by reference in its entirety. According to various alternative embodiments, the single-pocket device 100 is capable of processing, including denominating, currency bills at a rate ranging between about 800 to over about 1500 currency bills per minute.

While the single-pocket device 100 of FIGS. 3–5 has been described as a device capable of determining the denomination of processed currency bills, the system 50 utilizes note counting devices ("note counters") according to alternative embodiments of the present invention. Note counters differ from currency bill denominating devices in that note counters do not denominate the currency bills being processed and are not designed to process and determine the total value of a stack of mixed denomination currency bills. Note counters are disclosed in commonly owned U.S. Pat. Nos. 6,026,175; 6,012,565; and 6,493,461; each of which is incorporated herein by reference in its entirety.

In alternative embodiments of the system 50, currency bill processing devices having a plurality of output receptacles ("multi-pocket devices") are used as the bill device 52. Multi-pocket devices having two, three, four and six pockets are described in detail in the commonly owned U.S. Pat. No. 6,256,407, which is incorporated herein by reference in its entirety. Any of these various multi-pocket embodiments may be adapted for use in the system 50.

Figure 6:
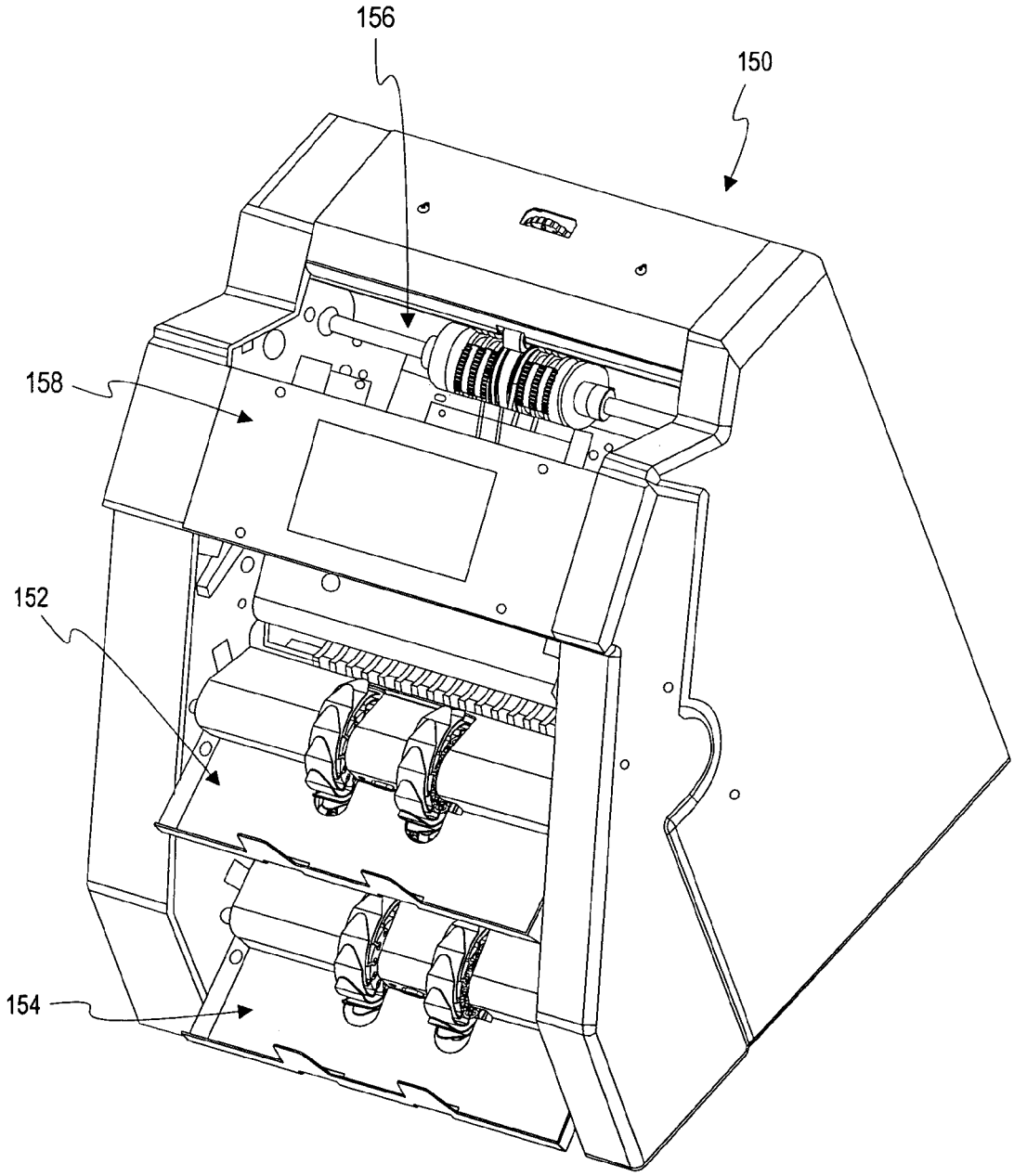
FIG. 6 is a perspective view of a two-pocket currency bill processing device for use with the currency bill and coin processing system of FIG. 1 according to an alternative embodiment of the present invention.
Figure 7:
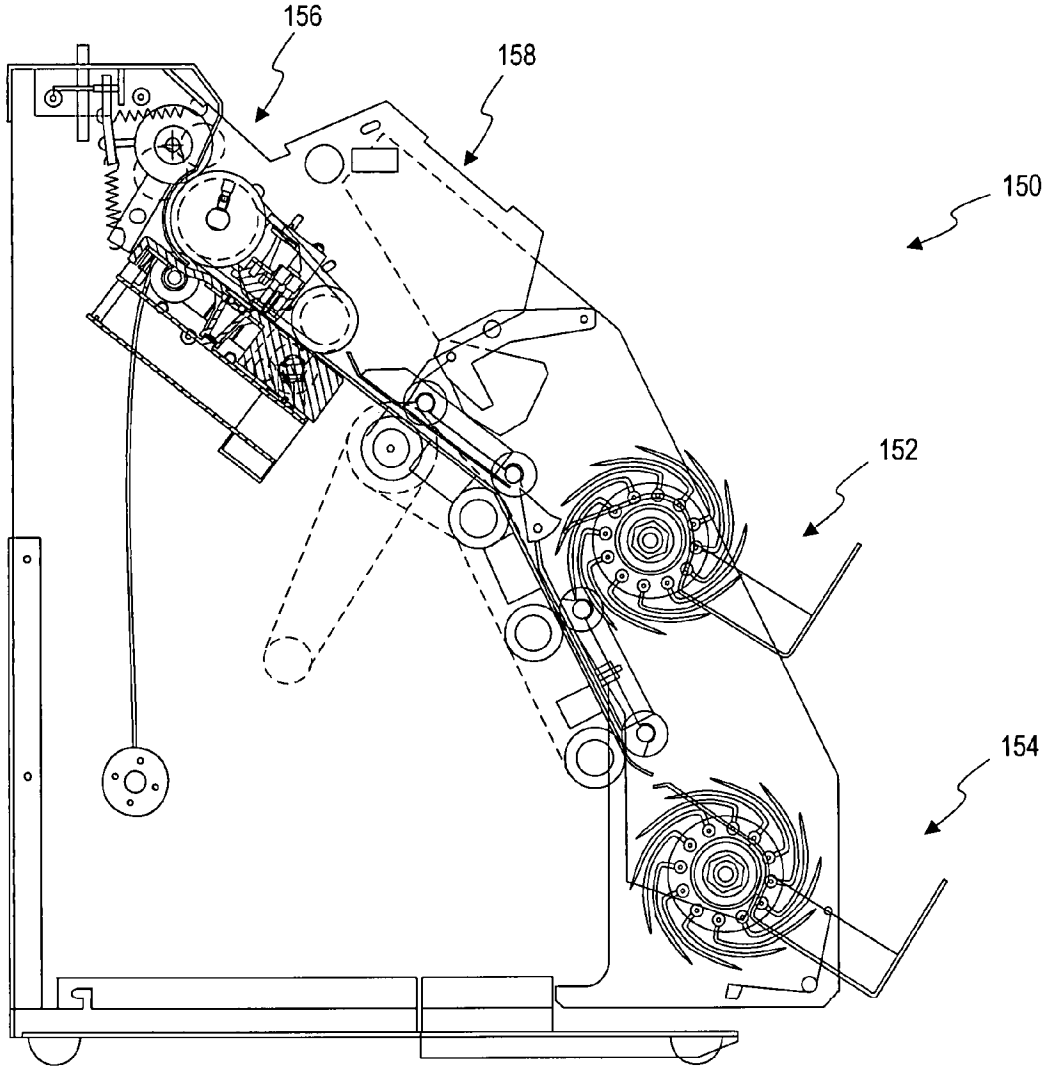
FIG. 7 is a cross-sectional view of the two-pocket currency bill processing device of FIG. 6.

Referring now to FIGS. 6 and 7, a currency bill processing device 150 having two output receptacles 152, 154 ("two-pocket device) is shown. The two-pocket device 150 can be used as the bill device 52 (FIG. 1) according to an alternative embodiment of the system 50. The two-pocket device 150 includes an input receptacle 156 (similar to that shown in FIG. 3) and an operator interface 158 (similar to that shown in FIG. 3) for communicating with an operator of the two-pocket device 150. Generally, the two-pocket device 150 operates in a manner similar to that of the single-pocket device 100 (FIGS. 3–5), except that the transport mechanism of the two-pocket device 150 is adapted to transport the currency bills to either of the two output receptacles 152, 154.

The two output receptacles 152, 154 may be utilized in a variety of fashions according to a particular application. For example, currency bills may be directed to the first output receptacle 152 until a predetermined number of currency bills have been transported (e.g., until the first output receptacle 152 reaches its capacity or a strap limit), and then directs subsequent currency bills to the second output receptacle 154. In another application, all currency bills are transported to the first output receptacle 152 except those currency bills triggering error signals, such as "no call" error signals (i.e., currency bill whose denomination is not identified) and "suspect document" error signals (i.e., currency bills failing an authentication test), which are directed to the second output receptacle 154. Further details of the operational and mechanical aspects of the two-pocket device 150 illustrated in FIGS. 6 and 7 are detailed in commonly owned U.S. Pat. Nos. 5,966,456; 6,278,795 18; and 6,311,819 18, each of which is incorporated herein by reference.

One of the contributing factors to the size of the two-pocket device 150, as well as the single-pocket device 100 and other multi-pocket devices, is the size of the currency bills to be handled. For example, some German Deutschmark notes are larger than United States currency bills. Therefore, if an application requires that a bill device 52 be able to process both United States and German notes, the transport mechanism of the device must be adapted to handle both sizes of notes. Accordingly, the size of the bill device 52 can vary according to alternative embodiments of the present invention.

Figure 8:
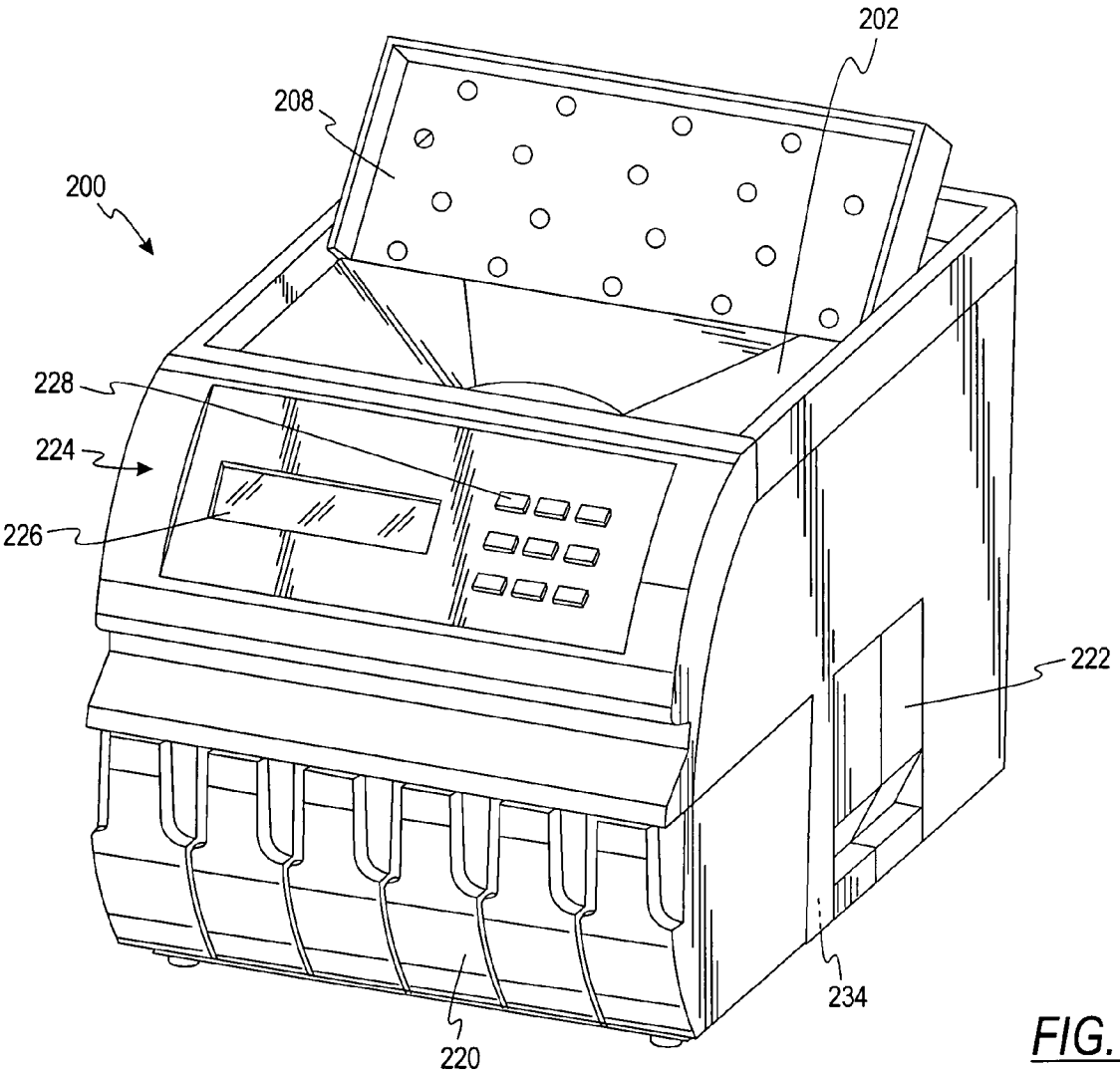
FIG. 8 is a perspective view of a coin processing device for use with the currency bill and coin processing system of FIG. 1 according to one embodiment of the present invention.
Figure 9:
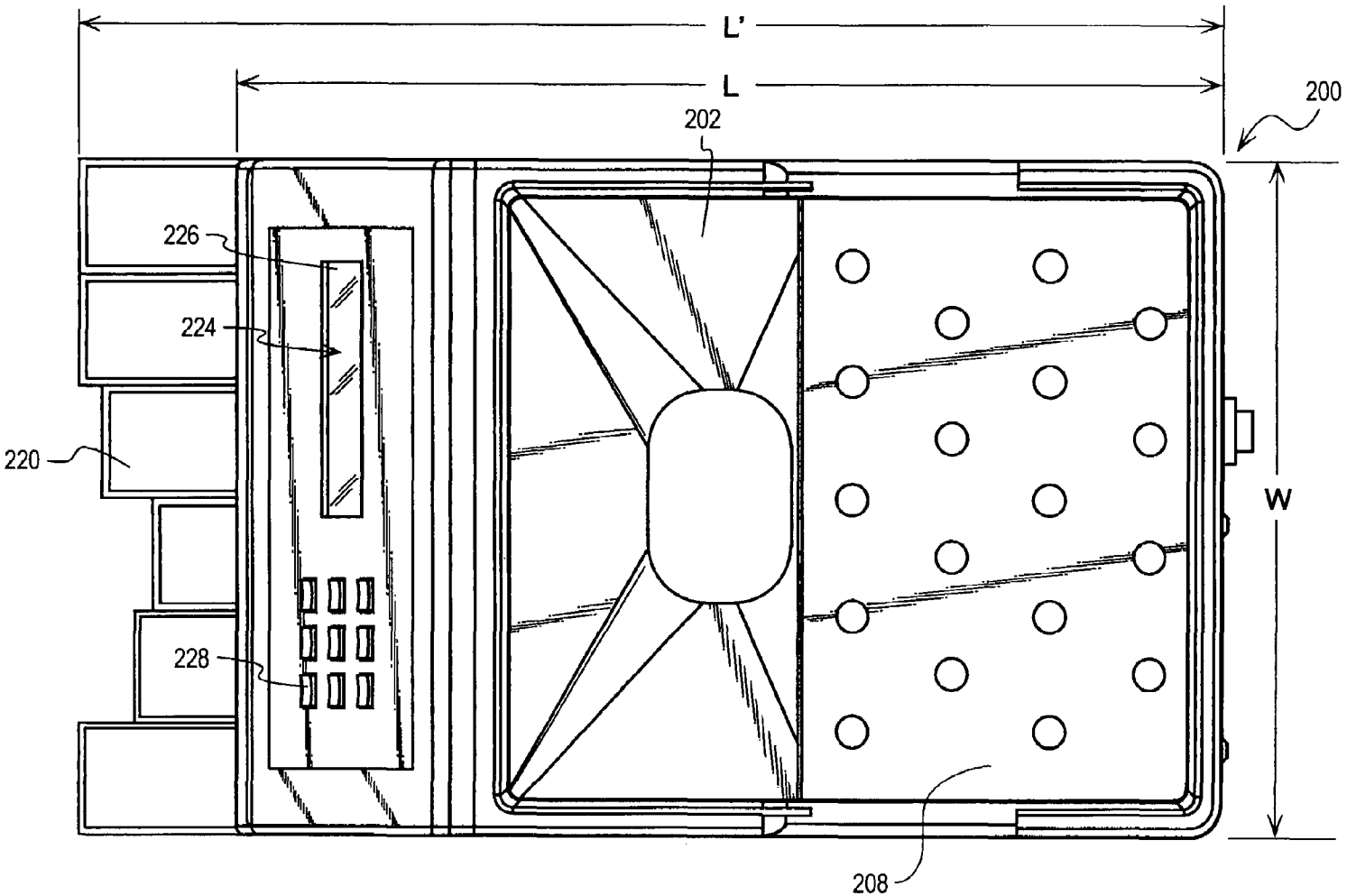
FIG. 9 is a top view of the coin processing device of FIG. 8.
Figure 10:
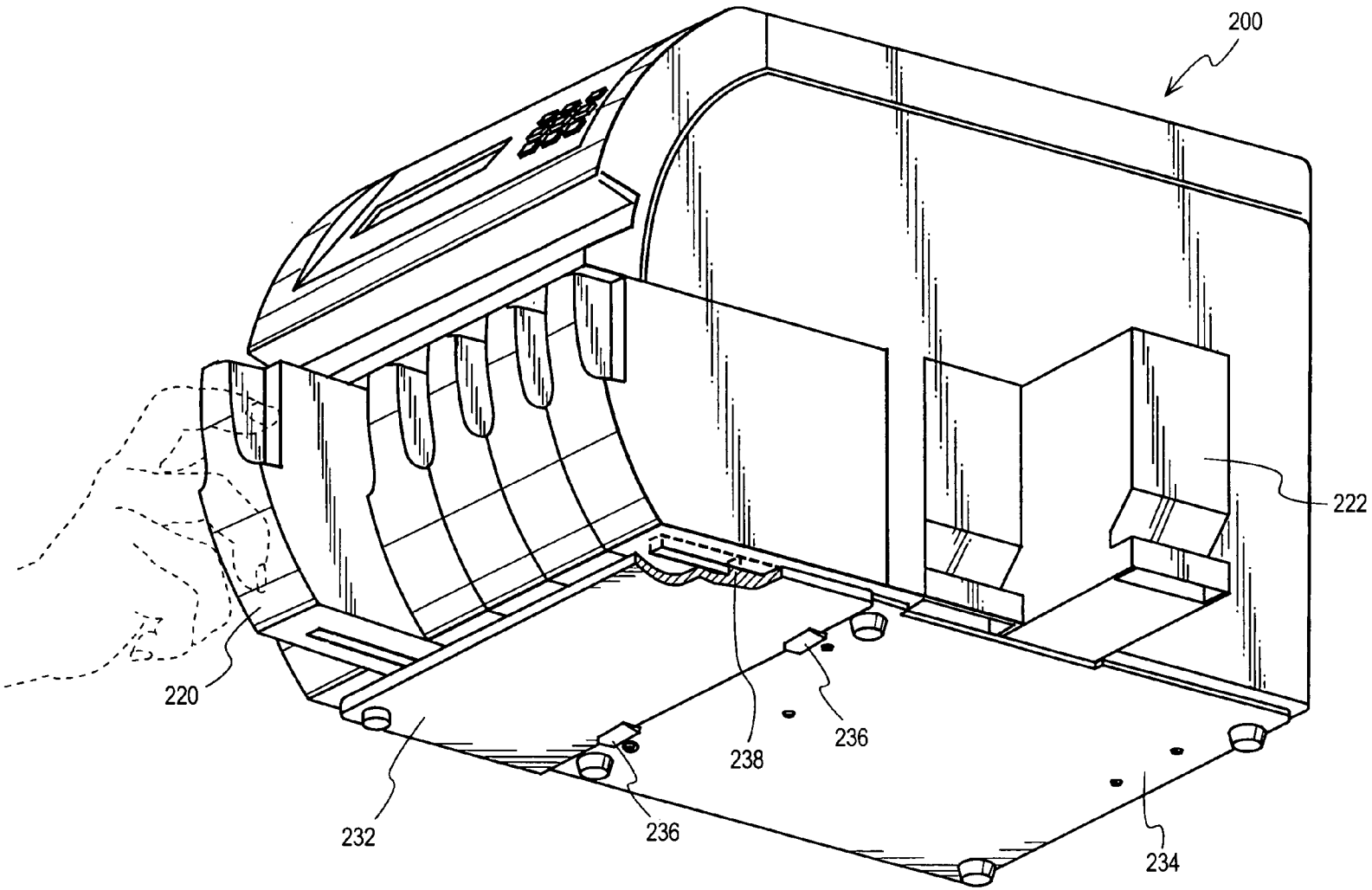
FIG. 10 is a bottom perspective view of the coin processing device of FIG. 8 illustrating the attachment of the coin bins.

Referring now to FIGS. 8–10, in one embodiment of the system 50 the coin device 54 is a coin processing device 200. The coin device 200 includes a coin tray 202 which receives coins of mixed denominations and feeds them through a central coin hopper 204 into an opening in an annular sorting head 206 positioned below the coin tray 202. The coin tray 202 includes a pivotable section 208 which can be lifted by the operator to urge the coins downwardly towards the opening in the coin tray 202. As the coins pass through the central opening of the sorting head 206, they are deposited on the top surface of a rotatable disc 210. The rotatable disc 210 comprises a resilient pad 212, preferably made of a resilient rubber or polymeric material, bonded to the top surface of a solid disc 214. While the solid disc 214 is often metal, it can be made of a rigid polymeric material as well.

As the rotatable disc 210 rotates, the coins deposited on the top surface thereof tend to slide outwardly across the surface of the pad 212 of the rotatable disc 210 due to the centrifugal force. As the coins move outwardly, those coins which are lying flat on the pad 18 enter the gap between the upper surface of the pad 212 and the sorting head 206 because the underside of the inner periphery of the sorting head 206 is spaced above the pad 212 by a distance which is approximately as large as the thickness of the thickest coin. As further described below, the coins are sorted into their respective denominations and discharged from exit channels corresponding to their denominations.

A unitary base member 216 is the primary mounting structure for numerous components in the coin device 10. Because of a need for minimizing the size of the coin device 54, the unitary base member 216 includes a plurality of integral coin chutes 218. The integral coin chutes 218 receive the sorted coins as they exit from the sorting head 206. The number of coin chutes 218 is typically the same for each coin device 54; however, the number of coin chutes 218 that are used in a particular coin device 54 will vary depending on the number of coins in the coin set.

The coins are sorted by their diameters within the sorting head 206, exit from the sorting head 206 into a plurality of coin chutes 218, and are captured in a plurality of coin bins 220 positioned on the exterior of the coin device 200. If the coin device 200 is to be used for sorting only six denominations (like in the United States coin set), then only the six coin bins 220 located on the front of the coin device 200 are used. Thus, the coin device 200 can fit and operate within a footprint that is defined by length L' and width W in FIG. 9. Alternatively, if the coin device 200 is to be used for sorting eight denominations, then two additional coin bins 222 can be placed along the side of the coin device 54.

The coin bins 220 can be removed entirely from the coin device 200 such that a till from a cash register or coin bags receive the sorted coins. The conversion of the coin device 200 for use with a till of a cash register and for use with coin bags will be discussed with reference to FIGS. 2 and 11.

An operator interface or control panel 224 is used by the operator to control the coin device 200. The operator interface 224 includes a display 226 for displaying information about the coin device 200. The operator interface 224 also includes keys 228 allowing the operator to enter information to the coin device 200. The operator interface 224 may also include a touch screen device which provides more versatility to the operator when inputting information to the coin device 200. The operator interface 224 also serves a structural purpose because it is the surface which closes the upper front portion of the coin device 200.

The operator of the coin device 200 may decide that the coin bins 220, 222 are not needed and, instead, that the coins must be directed into the cash till of a typical cash register. Because the coins are processed based on their diameters, not on their value, it is necessary to distribute the coins into a pattern that coincides with the coin receptacle locations in a cash till of a cash register. In the United States, the typical cash register has coin receptacles in which coins are placed in a manner of increasing value. In fact, most cash tills for cash registers use just one coin receptacle for both the half-dollars and dollars since they are used fairly infrequently. Thus, the standard United States cash register has only five coin receptacles.

Figure 11:
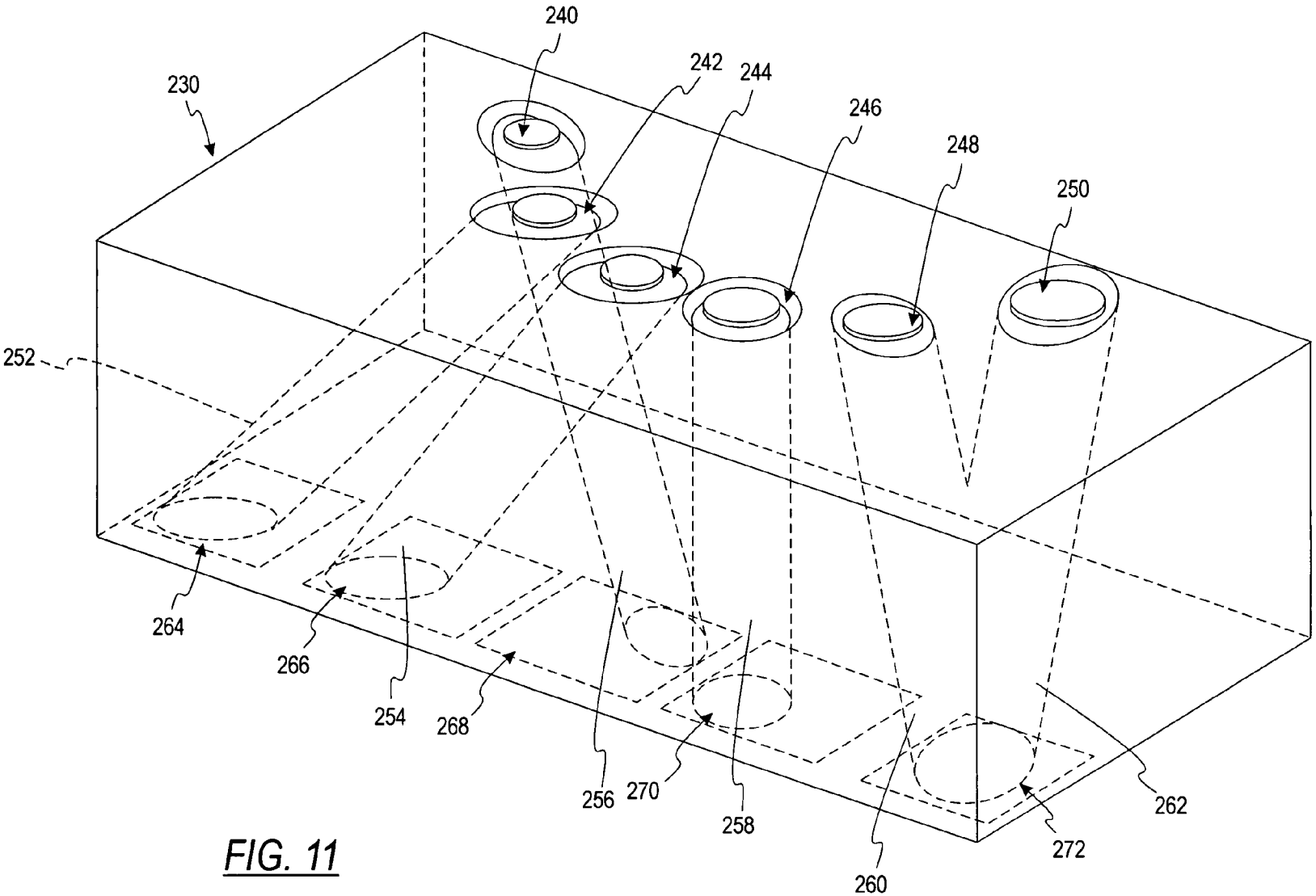
FIG. 11 is a perspective view of a manifold that is used to convert the path of sorted coins for compatibility with the till of a standard cash register.

In one embodiment of the invention, to convert the coin device 200 into a system that places coins into a cash till of a standard retail cash register, the coin device 200 includes a manifold 230 as shown in FIG. 11. If a coin bin platform 232 is of the type that requires removal to insert the manifold 230, then the coin bin platform 232 should be removed from a floor 234 of the coin device 200 by removing a number of fastening elements 236. The manifold 230 is then fixed to the coin device 200 preferably by hard-manipulating fasteners. If the coin bin platform 232 is of the type that is not removable from the floor 234, the manifold 230 may include a lower structure that allows it to slide into a number of projections 238.

The manifold 230 includes six inlets 240–250 which receive coins in the order of the diameters of the coins. In other words, when manifold 230 is used with the United States coin set, inlet 240 receives dimes, inlet 242 receives pennies, inlet 244 receives nickels, inlet 246 receives quarters, inlet 248 receives dollars, and inlet 250 receives half-dollars. But to place these coins in ascending value in a coin till, it is necessary to rearrange the flow of these coins along their respective coin paths. Accordingly, from the inlets 240–250, the coins travel down particular coin paths 252–262 which lead only to five outlets 264–272. Consequently, the dimes which enter inlet 240 are transported down path 256 to outlet 268. Pennies enter inlet 242 and pass down path 252 to outlet 264. Nickels enter inlet 244 and pass down path 254 to outlet 266. Quarters enter inlet 246 and pass down through path 258 to outlet 270. Dollars and half-dollars enter inlets 248 and 250, respectively, pass through paths 260 and 262, respectively, and enter into the same outlet 272.

The coin device 200 may not have enough space below its intermediate wall to accommodate both the manifold 230 and the cash till. Thus, the coin device 200 may be placed on a platform which increases the space underneath the intermediate wall. The platform may be configured such that the floor 234 is raised in a manner which allows a cash till to be inserted in a reversed direction than what is shown in FIG. 2. This may be beneficial because some countries have coin tills which are arranged with the increasing value of coins going from right to left, not left to right.

In other embodiments, the manifold 230 can be designed to have more or less coin inlets, paths, and outlets. and/or to sort the coins in a different order. For example, if the coins sorted are coins from two different countries, such as from the United States and from Canada, then ten coin paths might be required (i.e., two coin paths for pennies, one coin path for United States pennies and one coin path for Canadian pennies, two coin paths for dimes, one coin path for United States dimes and one coin path for Canadian dimes, etc.). In alternate embodiments, the manifold 230 can be designed to sort the coins in a different or non-conventional order. For example, if it is requested that the quarters should be placed in-between the dimes and the nickels, then the coin paths can be designed to accommodate such a design request.

As shown in FIG. 2, after the manifold 230 is attached to the coin device 54, which in this embodiment has been referred to using the reference number 200, a cash till 274 can be inserted under the manifold 230. The operator of the system then places the coins that are desired to be distributed to the till 274 into the coin tray 202 of the coin device 54. The operator then turns on the coin device 54 and the coins are sorted and distributed into the till 274. This results in a very efficient procedure by which retail checkers (e.g., a grocery store checker) inserts the entire day's worth of coins into the coin tray 202 and instructs the coin device 54 to begin sorting. The coin device 54 returns the coins to the till, and reads the value of the counted coins from the display 226 of the coin device 54 to assist him or her in verifying the amounts received in his or her till during the day. This saves the checker from having to count each of the coins present in the till by hand. Likewise, the use of the coin device 54 with the manifold 230 could also be helpful at the beginning of the day when a checker takes a given amount of money in currency and coins to the cash register and must determine the initial starting amount present in the cash till 274.

Because the coin device 200 has a width that is less than the typical cash till 274, the coin device 54 may include a conversion device 276 over the coin tray 202. The conversion device 276 is wide enough to allow the checker to insert his or her cash till 274 and dump the coins from the till 274 into the coin device 200 for processing without having to worry about the coins being spilled onto the floor. The conversion device 276 essentially funnels the coins into a lower aperture that is about as wide as the coin tray 202. Further details of the operational and mechanical aspects of the coin device 200 are detailed in commonly owned U.S. Pat. Nos. 5,997,395 and 6,139,418, each of which is incorporated herein by reference.

Figure 12:
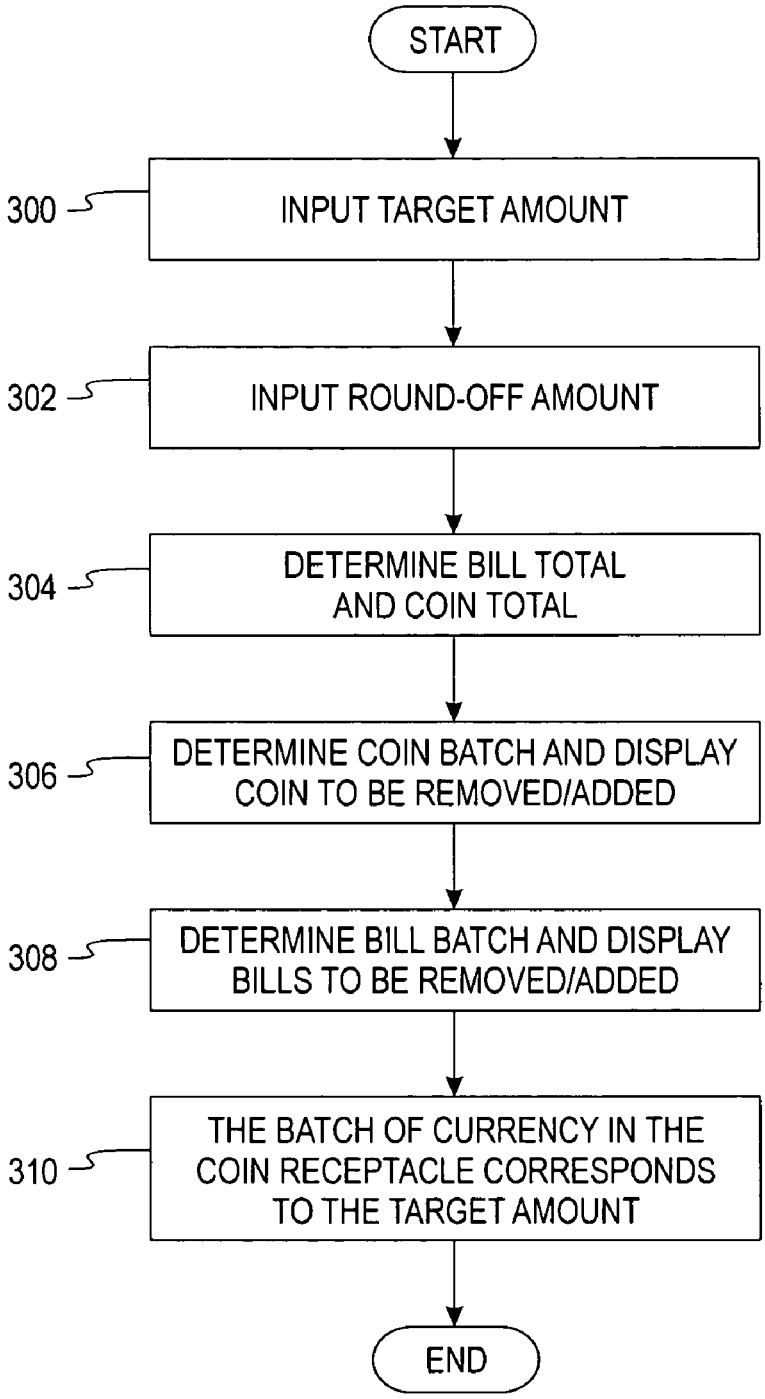
FIG. 12 is a flowchart illustrating the preparation of a cash till for the next work-shift according to one embodiment of the present invention.

Referring now to FIG. 12, an example of operation of the system 50 for assisting an operator in counting down a cash receptacle and preparing the cash receptacle to contain a batch of currency according to a predetermined target amount will be described. When an employee's shift is over, the employee is generally required to count all the money in the cash receptacle. Then, the employee must place a batch of currency in the cash receptacle for use as the next work-shift begins. The current invention provides a more efficient way to prepare the cash receptacle for the next work-shift.

In general, a target amount of cash is provided to the system 50, wherein the target amount of cash is a predetermined amount corresponding to the batch of currency that it is desired to be left in the cash receptacle for use at the beginning of a next work-shift. According to the target amount, which can be manually or automatically provided, the system 50 determines the amount of coins and the amount of currency bills that need to be removed from the cash receptacle. Thus, in general, the system 50 counts the total amount of money that is in the cash receptacle, including all the coins and all the currency bills, and then instructs the operator to add or remove cash from the cash receptacle to provide the batch of currency according to the target amount of cash. The steps below describe the activities performed by the system 50 and it is understood that they are not necessarily performed in the order that they are described. Furthermore, it is understood that the term cash receptacle is used generically, and that many different types of money storing devices can be used, such as cash bags or cash tills.

An operator brings the receptacle to the system 50, placing the bills in the bill device 52 and the coins in the coin device 54. Alternatively, the bills and/or the coins are placed in the corresponding devices using an automated process or a semiautomated process. At step 300 the operator selects the target amount of cash, which as explained above corresponds to the batch of currency placed back or left in the cash receptacle after counting down the receptacle. The batch of currency includes bills, coins, or both, and is also referred to as a total batch.

In one embodiment, the target amount of cash is a single number which corresponds to the total batch, which generally includes a bill batch and a coin batch. The system 50 can be, optionally, programmed to maintain a predetermined ratio between the coin batch and the bill batch which will make-up the total batch. For example, the system 50 can be programmed to maintain a 50/50 ratio between the coins and the bills. Alternatively, predetermined limits can be set for each type of currency, coins and bills. For example, a coin limit can be set to $50 and a bill limit can be set at $50. In another embodiment, the target amount of cash is two numbers, a first number corresponding to the bill batch and a second number corresponding to the coin batch.

The target amount can be selected by the operator, who can be an employee that has just finished the work-shift, every time the money from the cash receptacle is counted. Alternatively, the selection of the target amount can be restricted to only certain operators, such as supervisors, and the target amount can be preselected by the supervisors to be a default value. Thus, if the target amount is preselected, the operator does not have to select the target amount every time the cash receptacle is counted down.

At step 302, after a target amount is provided, by operator input or by default, a round-off amount is provided. Just like the target amount, the round-off amount can be inputted by the operator or it can be a preset value. In general, the round-off amount approximates to the next value down the number of coins that should be removed from the cash receptacle, so that a round amount of coins is left in the receptacle as the coin batch. For example, if the round-off amount is $1, then the coin batch will be rounded-down to the nearest lower dollar amount, e.g., both $20.99 and $20.01 will be rounded-down to $20.00. If the round-off amount is $5, then the coin batch will be rounded-down to the nearest whole dollar amount that is divisible by five, e.g., $24.99 and $22.49 will be rounded-down to $20.00. If the round-off amount is $10, then the coin batch will still be rounded-down to the nearest whole dollar amount that is divisible by five, e.g., $29.99 and $24.99 will be rounded-down to $20.00. In other embodiments, the round-off amount can be programmed to round-up to the nearest higher dollar amount, e.g., both $20.99 and $20.09 will be rounded-up to $21.00, or to round-up or round-down to the nearest dollar amount, higher or lower, e.g., $20.99 will be approximated to $21.00 and $20.01 will be approximated to $20.00.

At step 304, the system 50 processes the currency and determines the total amount of currency that is present in the cash receptacle. The bill device 52 counts the currency bills and determines the bill total, and the coin device 54 counts the coins and determines the coin total. After completion of this step, the system 50 knows the total amount of currency in the cash receptacle, including the bill total and the coin total.

At step 306, the system 50 determines the coin batch by rounding down the coin total, according to the selected round-off amount as explained above. Based on the coin total and on the coin batch, the system 50 determines the amount of coins that should be removed, if any, from the receptacle—a coin removal amount. Specifically, the coin removal amount is the difference between the coin batch and the coin total. Then, the system 50 instructs the operator to remove an amount of coins equal in value to the coin removal amount. For example, the system 50 tells the operator what amount should be removed, e.g., "Remove $3.38 in coins," or the system tells the operator how many coins of each denomination should be removed, e.g., "Remove 3 pennies, 1 nickels, 3 dimes, and 12 quarters."

Depending on the particular application requirements, a more sophisticated algorithm can be provided such that more coins of a first denomination are removed than coins of a second denomination. For example, if it is desired that quarters are more useful than dimes, nickels, or pennies, the system 50 will generally instruct the operator to remove most, if not all, of the pennies, nickels, and dimes before telling the operator to remove any quarters. At this point, based on the round-off amount and the coin total, the system 50 knows how many coins need to be left in the receptacle, i.e., the coin batch which equals the coin total minus the coins removed.

Although in most cases coins will be rounded down to the nearest lower dollar amount, it is possible to have the coins rounded up to the nearest higher dollar amount. For example, if the round-off amount is $1, and the coin total is $44.01, then the coin batch will be $45. Similarly, the system 50 can be allowed to round up or down, depending on which is the closest value. For example, assuming that the round-off amount is $1, a coin total of $44.49 will be rounded-down to $44.00 while a coin total of $44.50 will be rounded-up to $45.00. Note that in cases where the coin total can be rounded-up coins may have to be added instead of removed from the cash receptacle.

At step 308, the system 50 determines the bill batch (which is the amount of bills that are to be left in the receptacle after processing) by subtracting the coin batch from the target amount. Then, the bill batch is subtracted from the bill total to determine the amount of bills that should be removed from the cash receptacle—a bill removal amount. Alternatively, the operator can remove the bills directly from the bill device 52, after the bills have been processed, and then place the leftover bills (i.e., the bill batch) in the cash receptacle. Similar to the removal of coins, the system 50 can be adapted to display a specific amount, which means that the operator decides the denominations that will be included in the amount to be removed, or the system 50 can directly display how many bills from each denomination must be removed. For example, the system 50 can instruct the operator to "Remove $355," or to "Remove five $1 bills, two $5 bills, two $10 bills, one $20 bill, four $50 bills, and one $100 bill."

If at step 308 a determination is made that the bill batch is greater than the bill total, then the system 50 instructs the operator to add bills to the cash receptacle. Similar to that described above in relation to displaying the coin removal amount, the system 50 can instruct the operator to add a specific number of bills from each denomination, or it can instruct the operator to add a specified amount. If at step 308 the bill batch is equal to the bill total, then bills do not have to be removed or added, and consequently, the cash receptacle contains the appropriate bill batch.

At step 310, the cash receptacle contains the proper amount of currency and the cash receptacle is ready for the next work-shift. Thus, the batch of currency in the cash receptacle corresponds to the target amount. The operator places the cash receptacle back in the register, if the cash receptacle is a cash till, and the next work-shift can begin.

In alternative embodiments, the system 50 can have additional options. For example, the system 50 can have a media selection option for cash receptacles that contain more than one type of currency. For example, a retail store that transacts business near the border between United States and Canada might require the ability to account for both United States and Canadian dollars. The system 50 would provide, for example, a United States coin total, a Canadian coin total, a United States bill total, and a Canadian bill total, and respective coin removal and bill removal amounts.

Figure 13:
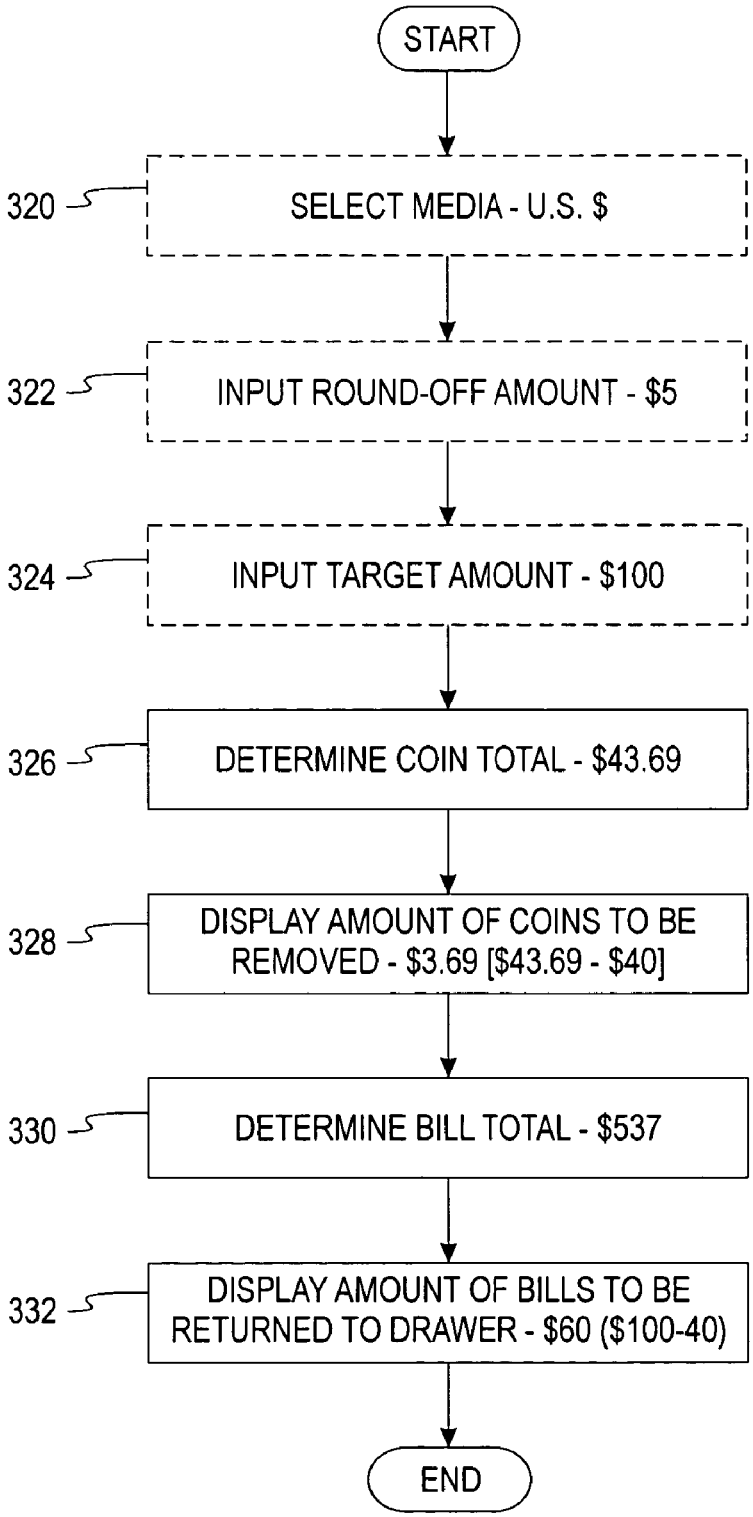
FIG. 13 is a diagram illustrating an example of preparing a cash till for the next work-shift according to one embodiment of the present invention.

Referring now to FIG. 13, an example of operation of the system 50 using specific dollar amounts will be described. After bringing the drawer to the system 50, the operator selects at step 320 the appropriate media to be United States currency. Then, at step 322 the operator inputs the round-off amount to be $5. This means that the coin batch will be rounded down to the nearest whole dollar amount that is divisible by five. At step 324, the operator inputs the target amount to be $100. It is to be noted that each one of these first three steps might be the same for a longer period of time, e.g., a week, a month, a year, etc. In other words, the media can always be United States currency, the round-off amount can always be $5, and the target amount can always be $100. To save time, each one of these steps can be preset and, therefore, eliminated from the day-to-day routine. However, the operator can have the option to change any one of the preset steps, at any time.

The system 50 determines at step 326 that the coin total in the drawer is $43.69. At step 327, the system 50 rounds-off the coin total according to the round-off amount. Because the round-off amount is $5, the rounded-amount or coin batch within the nearest $5 increment is $40. At step 328, the system 50 determines the coin removal amount, which is equal to the coin total, $43.69, minus the coin batch, $40. Assuming that $40 in coins satisfies a predetermined setting of coins to bills ratio or coins/bills limits, the $40 rounded-amount is the coin batch and the amount of coins to be removed is $3.69. Thus, $40 in coins is the amount that should remain or be returned to the drawer. For example, a display can instruct an operator to remove $3.69 in coins from the coin total, to return-to-drawer $40 in coins from the coin total, or both.

At step 330, the system 50 determines that the bill total is $537. Assuming that all the bills have been removed from the drawer for processing, then, at step 332, the bill amount to be "Returned to Drawer" is determined. The target amount has been set to $100, and the coin batch has been determined to be $40. The bill batch is calculated by subtracting the coin batch ($40) from the target amount ($100), resulting in $60. The bill "Return to Drawer" amount is equal to the bill batch, which is the difference between the target amount and the coin batch, i.e., $100 minus $40. The amount of bills to be returned to drawer equals $60. After the operator removes $3.69 in coins and returns $60 in bills to drawer, the drawer will contain $100, $40 in coins and $60 in bills. The operator can be instructed to return-to-drawer $60 in bills, or, alternatively, to remove $477 in bills from the bill total and then return the leftover to the drawer. Thus, effectively, the method allows the operator to remove $3.69 in coins and $477 in bills ($537–$60) from the coin total and the bill total that was present in the drawer before processing. The operator places the drawer back in the register, which is then ready for the next work-shift.

In another embodiment, the system 50 is provided with a limit on either the coin batch or on the bill batch, to maintain a desired balance of coins and bills in the cash receptacle. The limit can be an upper limit, a lower limit, or both. For example, if the target amount is $100 and the coin batch is $90, it may be undesirable to have $90 in coins and $10 in bills. Thus, an upper limit can be imposed such that the coin batch will be a coin upper limit if the coin batch is higher than the coin upper limit. In the previous example, if the coin upper limit is $50, then it is guaranteed that the prepared cash receptacle will include no more than $50 in coins. Similarly, a lower limit can be imposed such that the coin batch will be a coin lower limit if the coin batch is lower than the coin lower limit. In the previous example, if the coin lower limit is $25, then it is guaranteed that the prepared cash receptacle will include at least $25 in coins. Similarly, the same principle applies to the bills, by applying a bill upper limit and a bill lower limit. Alternatively, instead of limits, the coin and bill limits can be presented as percentages or ratios. For example, the operator can provide a desired bill and/or coin percentage, e.g., 40% coins, and the system 50 will calculate the appropriate amounts.

In another embodiment, the system 50 can process cash one denomination at a time. Processing cash amounts that include only a single denomination can be useful in places such as casinos where business may be generally transacted by using a particular denomination, e.g., quarters. Another benefit of processing cash by denomination is that an operator can prepare a plurality of cash tills generally simultaneously for the next work-shift.

A large retail store, for example, can have tens of cash registers and several work-shifts during a single day. To decrease the down-time associated with the countdown and preparation of the cash tills, an operator can prepare a plurality of cash tills with minimal effort in a short time. For example, an operator might have to prepare ten empty cash tills for use in a next work-shift. The operator will bring storage bags containing coins and/or cash for each denomination. Assuming that the target amount is preselected for each denomination, the operator loads the system 50 with a first denomination and then places a first cash till in the appropriate location for receiving the first denomination, e.g., using a manifold such as the manifold 230 described above in reference to FIG. 11. The system 50 then processes the first denomination and transports the first denomination to the first cash till. When the target amount for the first denomination is reached, the system 50 stops and the operator replaces the first cash till with a second cash till. Then, the system 50 processes the first denomination until the target amount is reached for the second cash till. The process is repeated until all ten cash tills have the target amount of the first denomination, i.e., all ten cash tills contain the desired amount of the first denomination. After the first denomination is processed, the operator repeats the process using other denominations, e.g., pennies, dimes, nickels, half-dollars, full-dollars, any other coins, $1 bills, $5 bills, $10 bills, $20 bills, $50 bills, $100 bills.

According to one embodiment the software for performing any one of the functions described above in reference to FIGS. 13 and 14, is stored only in the memory of the coin processing device 54. The stored software in the memory of the coin device 54, in conjunction with the currency bill processing device 52, helps in processing a cash till as described above in reference to FIGS. 13 and 14. Consequently, in this embodiment an external memory such as a memory included in an external computer, e.g., a personal computer, is not required.

Figure 14:
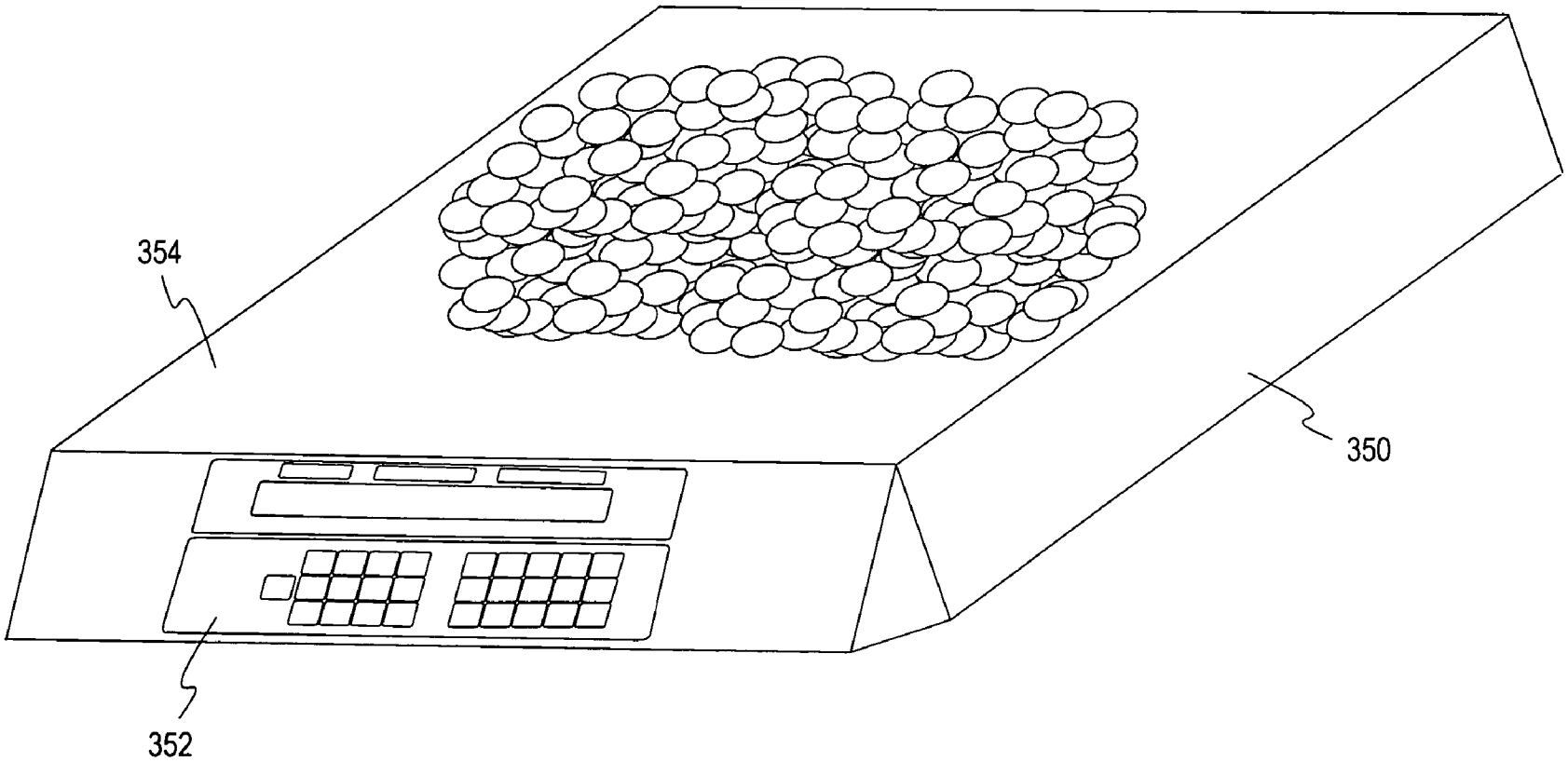
FIG. 14 is a perspective view of a coin scale for use with the currency bill and coin processing system of FIG. 1 according to an alternative embodiment of the present invention.

Referring now to FIG. 14, a detailed description will be provided for a coin scale 350, which can be used as the coin processing device 54 according to one embodiment of the currency bill and coin processing system 50. The coins scale 350 can weigh coins of a single denomination and then calculate the total value of the weighed coins based on the weight of the coins. The coin scale 350 has a compact size, which allows it to be used on a tabletop or desktop.

According to the illustrated embodiment, the coin scale 350 includes an operator interface 352 having an LCD display for displaying information to an operator and a keypad for receiving input from an operator. To determine the value of the coins processed, the operator, using the operator interface 352, inputs information indicative of the denomination of coins about to be weighed.

According to one embodiment, a plurality of denomination-specific algorithms are stored in a memory of the coin scale 350 for calculating the aggregate value of coins based upon the weight of the coins. For example, if it is desired to determine the aggregate dollar-amount of a plurality of quarters, the operator places the quarters on a tray 354 of the coin scale 350 and inputs via the operator interface 352 that quarters are to be processed. Then, the coin scale 350 determines the aggregate dollar amount of the quarters, based upon their weight, and displays the determined amount to the operator. The coins placed on the tray 354 can comprise bagged coins, loose coins, and rolled coins. In addition to government issued coins, the coin scale 350 can be programmed to weigh and process other types of "coins" including casino tokens, transit tokens, and other types of tokens.

According to another embodiment, it is unnecessary for the operator to input the coin denomination to be weighed; rather, the coin scale 350 automatically prompts the operator to weigh coins of a specific denomination and sequentially prompts the operator to weigh another specific coin denomination. The coin scale 350 prompts the operator, after the previous denomination has been weighed, while the coin scale 350 checks through a list of coin denominations stored in a memory. For example, upon activation, the coin scale 350 instructs the operator, via the operator interface 352, that pennies are to be placed on the tray 354. The coin scale 350 weighs the pennies and determines the penny total, which is added to a running total. After the penny total is determined, the coin scale indicates to the operator to place nickels on the coin tray 354. If the operator does not have any nickels for weighing, the operator can indicate so via the operator interface 352 by pressing a continue button. After each coin denomination is weighed, the coin scale 350 prompts the operator to weigh the next coin denomination until the predetermined list (e.g., the coins in the U.S. coin set) is exhausted. The coin scale 350 checks through the list in a logical sequence (e.g., in increasing or decreasing order of denomination value) or in a different preprogrammed manner.

According to an alternative embodiment of the present invention, the coin scale 350 is capable of determining a total dollar amount of a batch of rolled coins of mixed denominations. For example, according to such an embodiment, the coin scale 350 can determine that a roll of quarters (typically having forty quarters) and a roll of dimes (typically having fifty dimes), both placed on the tray 354 simultaneously, has a collective value of fifteen dollars.

According to one embodiment, when counting loose coins of several denominations with the coin scale 350, each coin denomination is processed by itself. Thus, it is first necessary to segregate the coins by denomination. Often, in the retail or banking environment, coins are already segregated in a cash till drawer according to denomination. The operator must input the denomination of other coins to be processed via the operator interface 352, or allow the coin scale to advance to subsequent denominations according to a preprogrammed sequence of coin denominations. As each coin denomination is counted, the determined total corresponding to each denomination is stored in a memory of the coin scale 350 or a memory of the currency bill and coin processing system 50. The totals are then summed after all coin denominations have been counted. Alternatively, a running total is maintained as the different coin denominations are being processed. According to one embodiment of the present invention, the coin scale 350 includes a "zeroing option" which resets the weight on the scale account for the weight of a container into which loose coins are placed. Put another way, the zeroing option accounts for the tare weight. For example, a dish may be placed on the tray 354 and then a zeroing button on an operator interface is depressed, which sets the scale back to zero so that the weight of the dish is not included in the weight of coins to be placed in the dish.

According to alternative embodiments of the present invention, the coin scale 350 is capable of weighing and processing loose currency or strapped, banded, bundled or clipped stacks of currency. The coin scale 350 weighs the currency and determines a corresponding dollar amount. In addition to government issued currency, the coin scale 350 can be programmed to weigh and processes other types of "currency" including casino script, bar coded tickets, coupons, food stamps, postage stamp, etc.

According to one embodiment, the coin scale 350 is a compact device which can be rested on a tabletop. A coin scale that can be used in one embodiment of the currency bill and coin processing system 50 is commercially available from Digi Matex, Inc. (Model No. DMC-688). Another coin scale that can be used is a TellerMate scale, which is made by Percell Group PLC.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A method for processing currency bills and coins in a cash processing system that includes a currency bill processing device and a coin processing device, said cash processing system including a resident memory, comprising:

providing a cash receptacle containing a plurality of currency bills and a plurality of coins;

providing a target amount of cash to be stored in said cash receptacle, said cash being stored after a removing step is performed;

determining a coin total corresponding to the value of said plurality of coins in said cash receptacle by using said coin processing device;

determining a bill total corresponding to the value of said plurality of bills in said cash receptacle by using said currency bill processing device;

determining a bill removal amount;

removing said bill removal amount worth of currency bills from said plurality of currency bills provided in said cash receptacle; and storing remaining currency bills and coins in said cash receptacle, the total amount of remaining currency bills and coins corresponding to said target amount of cash.

2. The method of claim 1, further comprising:

rounding-down said coin total;

determining a coin removal amount corresponding to the difference between said coin total and the rounded-down coin total; and removing a coin removal amount worth of coins from said cash receptacle.

3. The method of claim 2, wherein rounding-down comprises rounding-down to the nearest whole dollar amount.

4. The method of claim 2, wherein rounding-down comprises rounding-down to the nearest whole five dollar amount.

5. The method of claim 2, wherein determining said bill removal amount comprises:

determining a bill batch amount by subtracting said coin total from said target amount; and subtracting said bill batch amount from said bill total.

6. The method of claim 1, further comprising displaying said bill removal amount to an operator.

7. The method of claim 2, further comprising displaying said coin removal amount to an operator.

8. The method of claim 2, further comprising instructing an operator how many coins from each denomination are included in said coin removal amount.

9. The method of claim 1, further comprising instructing an operator how many bills from each denomination are included in said bill removal amount.

10. The method of claim 1, further comprising:

selecting more than one currency media; and determining said bill removal amount for each selected currency media.

11. The method of claim 1, further comprising restricting operator access such that only predetermined operators are able to provide said target amount of cash.

12. The method of claim 1, further comprising printing a receipt showing at least one of said target amount, said coin total, said bill total, and said bill removal amount.

13. The method of claim 1, further comprising:

providing a plurality of coins of a single denomination; and counting said plurality of coins of a single denomination until reaching said target amount of cash.

14. The method of claim 1, further comprising:

providing a plurality of currency bills of a single denomination; and counting said plurality of currency bills of a single denomination until reaching said target amount of cash.

15. A method for processing currency bills and coins in a system including a currency bill processing device and a coin processing device, at least one of said bill device and said coin device including a resident memory, comprising:

providing a cash receptacle having a plurality of currency bills and coins;

determining a currency bill total using said currency bill processing device, and determining a coin total using said coin processing device;

providing a round-off amount and a total amount, said total amount being a cash amount desired for availability in said cash receptacle after an adjusting step;

determining a coin batch by using said round-off amount to approximate said coin total to a predetermined dollar amount;

subtracting said coin batch from said total amount to obtain a bill batch;

determining a coin difference amount by subtracting said coin batch from said coin total;

determining a bill difference amount by subtracting said bill batch from said currency bill total; and adjusting said cash receptacle in accordance with said coin difference amount and said bill difference amount, an operator removing an amount of coins equal to said coin difference amount if said coin difference amount is a positive number, said operator removing an amount of currency bills equal to said bill difference amount if said bill difference amount is a positive number, said operator adding an amount of coins equal to said coin difference amount if said coin difference is a negative number, and said operator adding an amount of currency bills equal to said bill difference amount if said bill difference amount is a negative number.

16. A system for processing currency bills and coins in a cash receptacle for automatically determining a currency batch, comprising:

a coin device for counting coins in the cash receptacle and determining a coin total;

a bill device for counting bills in the cash receptacle and determining a bill total, said bill device being communicatively linked to said coin device;

a memory being resident on at least one of said coin device and said bill device, said memory storing an operating mode for processing currency bills and coins, said memory further storing a target amount; and a central processing unit for determining a bill removal amount, said bill removal amount being the difference between said target amount and a total of said coin total and said bill total, said central processing unit being communicatively linked to at least one of said coin device and said bill device.

17. The system of claim 16, wherein said cash receptacle is at least one cash bag.

18. The system of claim 16, wherein said cash receptacle is a cash till.

19. The system of claim 16, wherein said cash receptacle is a register drawer.

20. The system of claim 16, further comprising at least one printer, said printer being communicatively linked to at least one of said bill device and said coin device.

21. The system of claim 16, further comprising a manifold for transporting the processed plurality of coins from said coin device to said coin receptacle.

22. A method for processing currency bills and coins in a cash processing system that includes a currency bill processing device and a coin processing device, said cash processing system including a resident memory, comprising:

providing a drawer containing a plurality of currency bills and a plurality of coins;

providing a target amount of cash to be returned to said drawer, said cash being returned after said plurality of currency bills and said plurality of coins are processed;

determining a coin total corresponding to the value of said plurality of coins in said drawer by using said coin processing device;

determining a bill total corresponding to the value of said plurality of bills in said drawer by using said currency bill processing device;

determining a return-to-drawer bill amount; and returning said return-to-drawer bill amount worth of currency bills to said drawer.

23. The method of claim 22, further comprising:

determining a return-to-drawer coin amount; and returning said return-to-drawer coin amount worth of coins to said drawer.

* * * * *